US011203464B2

(12) United States Patent
Gregorian

(10) Patent No.: US 11,203,464 B2
(45) Date of Patent: Dec. 21, 2021

(54) STORAGE TUBE AND CAP ASSEMBLY

(71) Applicant: GE Plastics, L.L.C., Fort Myers Beach, FL (US)

(72) Inventor: John E. Gregorian, Fort Myers Beach, FL (US)

(73) Assignee: GE PLASTICS, L.L.C., Fort Myers Beach, FL (US)

( * ) Notice: Subject to any disclaimer, the term of this patent is extended or adjusted under 35 U.S.C. 154(b) by 189 days.

(21) Appl. No.: 16/513,594

(22) Filed: Jul. 16, 2019

(65) Prior Publication Data

US 2021/0016935 A1 Jan. 21, 2021

(51) Int. Cl.

| | |
|---|---|
| ***A24F 13/00*** | (2006.01) |
| ***B65D 43/02*** | (2006.01) |
| ***B65D 53/02*** | (2006.01) |
| ***B65D 85/12*** | (2006.01) |
| ***A24F 15/12*** | (2006.01) |

(52) U.S. Cl.

CPC ..... *B65D 43/022* (2013.01); *A24F 15/12* (2013.01); *B65D 53/02* (2013.01); *B65D 85/12* (2013.01); *B65D 2543/00092* (2013.01); *B65D 2543/00509* (2013.01); *B65D 2543/00731* (2013.01); *B65D 2543/00796* (2013.01); *B65D 2543/00842* (2013.01); *B65D 2543/00972* (2013.01)

(58) Field of Classification Search

CPC ..... A47F 13/18; A47F 13/14; A47F 13/12; A47F 13/08; A47F 13/02; A47F 15/18; A47F 15/08; A47F 19/0035; A47F 19/0064; A47F 19/02; A47F 17/00

USPC ..... 206/246, 236; 131/256

See application file for complete search history.

(56) References Cited

U.S. PATENT DOCUMENTS

| | | | | |
|---|---|---|---|---|
| 1,747,591 A * | 2/1930 | Moore | B65D 43/022 220/804 |
| 4,358,024 A * | 11/1982 | Underwood | B65D 45/327 220/234 |
| 10,888,114 B2 * | 1/2021 | Chipman | A24F 15/12 |
| 2018/0360109 A1 * | 12/2018 | Nguyen | F23Q 2/32 |

* cited by examiner

*Primary Examiner* — King M Chu
(74) *Attorney, Agent, or Firm* — Prospect Law LLP

(57) ABSTRACT

A storage tube assembly, with a cap having a top surface and a sealing member connected to the top surface, the sealing member has a generally cylindrical upper wall and a generally cylindrical lower wall, the sealing member also has a recessed portion between the upper wall and lower wall and a flange cut into the lower wall; a sealing ring, the sealing ring is sized to cooperate with and be received in the recessed portion of the sealing member of the cap; and a tube, the tube has a generally circular inner wall with a cut therein, the cut in the inner wall is positioned to receive the sealing ring when the sealing ring is positioned within the recessed portion of the cap and the cap is placed into an open end of the tube.

18 Claims, 15 Drawing Sheets

STORAGE TUBE AND CAP ASSEMBLY

FIELD OF THE INVENTION

The present disclosure relates generally to a storage tube and cap assembly. More specifically, the present disclosure relates to an improved tube and cap assembly with a cap, a tube and an O-ring. The cap has a top with an offset, crescent-shaped tab. The bottom portion of the cap also has a flange cut segment. The O-ring is placed into a groove in the bottom portion of the cap. Further, the assembly includes an elongated cylindrical tube into which the cap is placed to seal the tube. The tube has a circular side cut along the perimeter of an inner wall. The side cut in the tube is positioned to receive the O-ring when the cap is properly placed into the tube.

SUMMARY

A new storage tube and cap assembly is disclosed herein. The new assembly provides for an improved air-tight seal, which provides improved longevity and freshness for products stored within the tube assembly. Products that can be stored in the assembly include cigars or other types of products that need to be sealed to maintain freshness over a period of time. The cap's tab and flange, the O-ring, and a side cut in the inside wall of the tube, all described in more detail below, allow for improved ergonomic use and ease of digital manipulation when opening the sealed tube by lifting up on the cap as well as improved sealing of the tube.

Embodiments of the storage tube assembly may include one or more of the following, in any combination, a cap with a top and a sealing member connected to the top. The sealing member may have a generally cylindrical upper wall and a generally cylindrical lower wall. The sealing member may have a groove between the upper wall and lower wall. A sealing ring is provided that is sized to be received within the groove of the sealing member of the cap.

The assembly also has a tube with a generally circular inner wall with a cut therein. The cut in the inner wall is positioned such that when the sealing ring is positioned within the groove of the cap and the cap is placed into an open end of the tube, the sealing ring forms a seal between the tube and the cap. The storage tube assembly has a generally crescent shaped tab. The cut in the inner wall of the tube has a generally round cross-section. The cut in the inner wall of the tube has a generally square cross-section. The cut in the inner wall of the tube has a generally V-shaped cross-section. The sealing ring is made of an elastomeric material. The cap's sealing member also has a flange cut into a portion of the generally cylindrical lower wall. The flange extends generally outwardly from a bottom end of the cylindrical lower wall. The flange cut is positioned beneath the tab.

BRIEF DESCRIPTION OF THE DRAWINGS

The foregoing aspects and many of the advantages of the disclosed embodiments will become more readily appreciated by reference to the following detailed description, when taken in conjunction with the accompanying drawings, wherein.

DETAILED DESCRIPTION

It is contemplated that the subject matter described herein may be embodied in many forms. Accordingly, the embodiments described in detail below are the presently preferred embodiments, and are not to be considered limitations.

Figure 1:
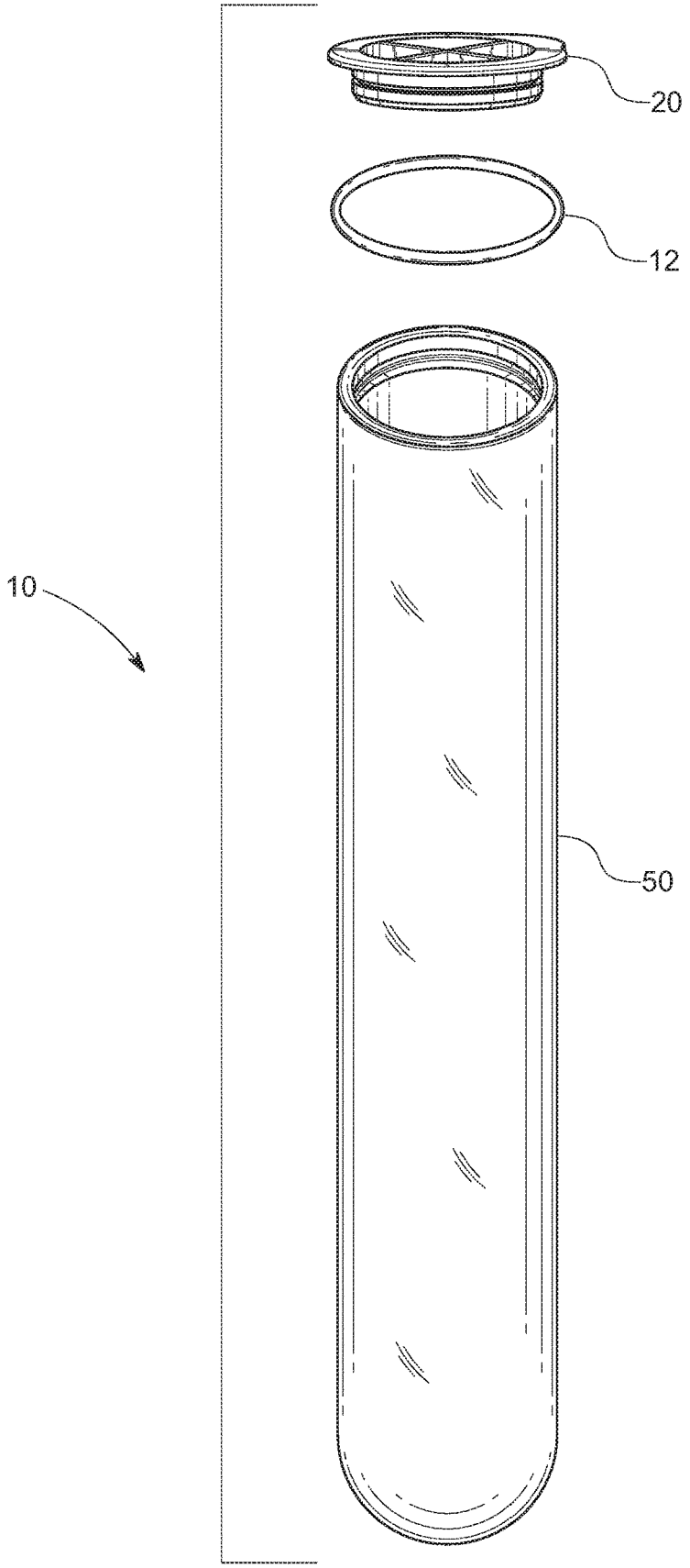
FIG. 1 is an exploded view of a storage tube and cap.
Figure 2:
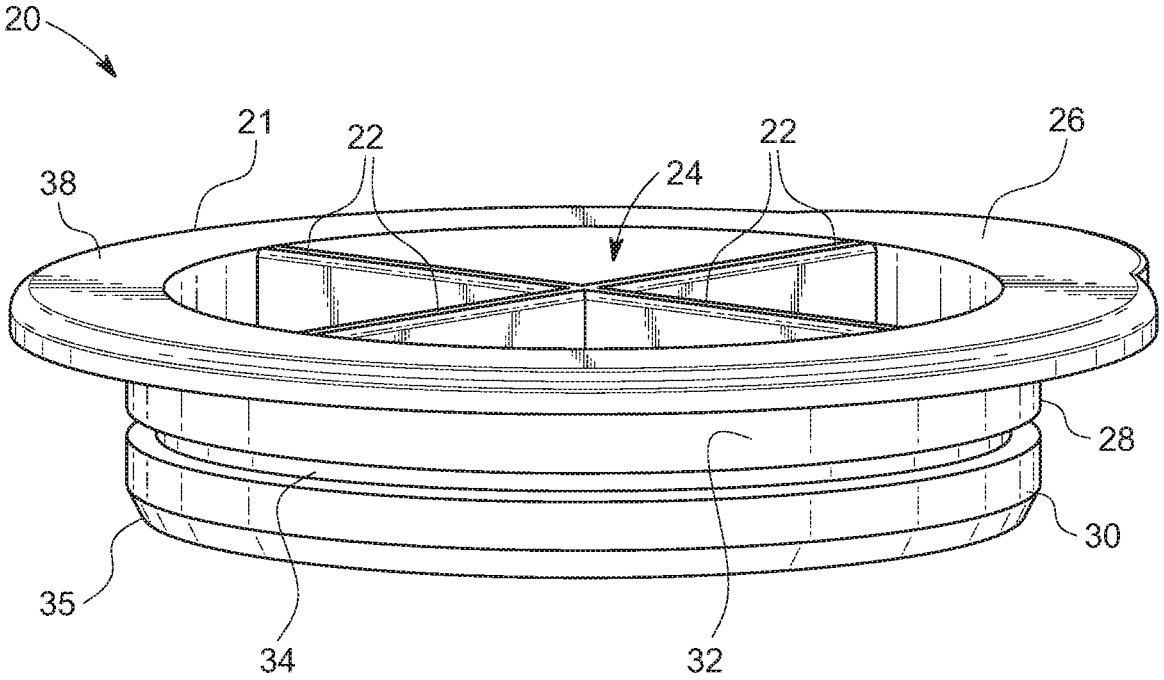
FIG. 2 is a side perspective view of the cap shown in FIG. 1.

The discussion will now turn to FIG. 1, which is an exploded view of a storage tube and cap assembly. The assembly is particularly useful for storing perishable goods that should be stored in air-tight conditions, such as cigars, cigarettes, etc.

The assembly 10, shown in FIG. 1 includes a cap 20, an O-ring 12 and a tube 50. The cap 20 may be made of a polymeric material or a mixed polymeric and non-polymeric material. Similarly, the O-Ring 12 may also be made of a polymeric material or a mixed polymeric and non-polymeric material. Preferably the O-ring may also be made of an elastomeric material that allows it to be placed onto the cap and form a seal with the tube (as described below). The O-Ring 12 which, as described below, operates as a sealing ring, may be made in a number of different shapes, sizes, colors, or grades. The tube 50 may be made of a polymeric material or a mixed polymeric and non-polymeric material or glass. The polymeric materials used to make the cap 20, O-Ring 12 and tube 50, may be made of one or more layers of plastic that have good oxygen barrier properties or that contain an oxygen scavenger material within the plastic or between layers of plastic.

As shown in FIGS. 2-6, the cap 20 has a top ring portion 21, having an upper surface 38 and a lower surface 36. As shown, the top ring portion 21 has interior support walls 22 for stability and structural support. The top ring portion 21 also contains several areas of hollow space 24 between the interior support walls 22.

Figure 7:
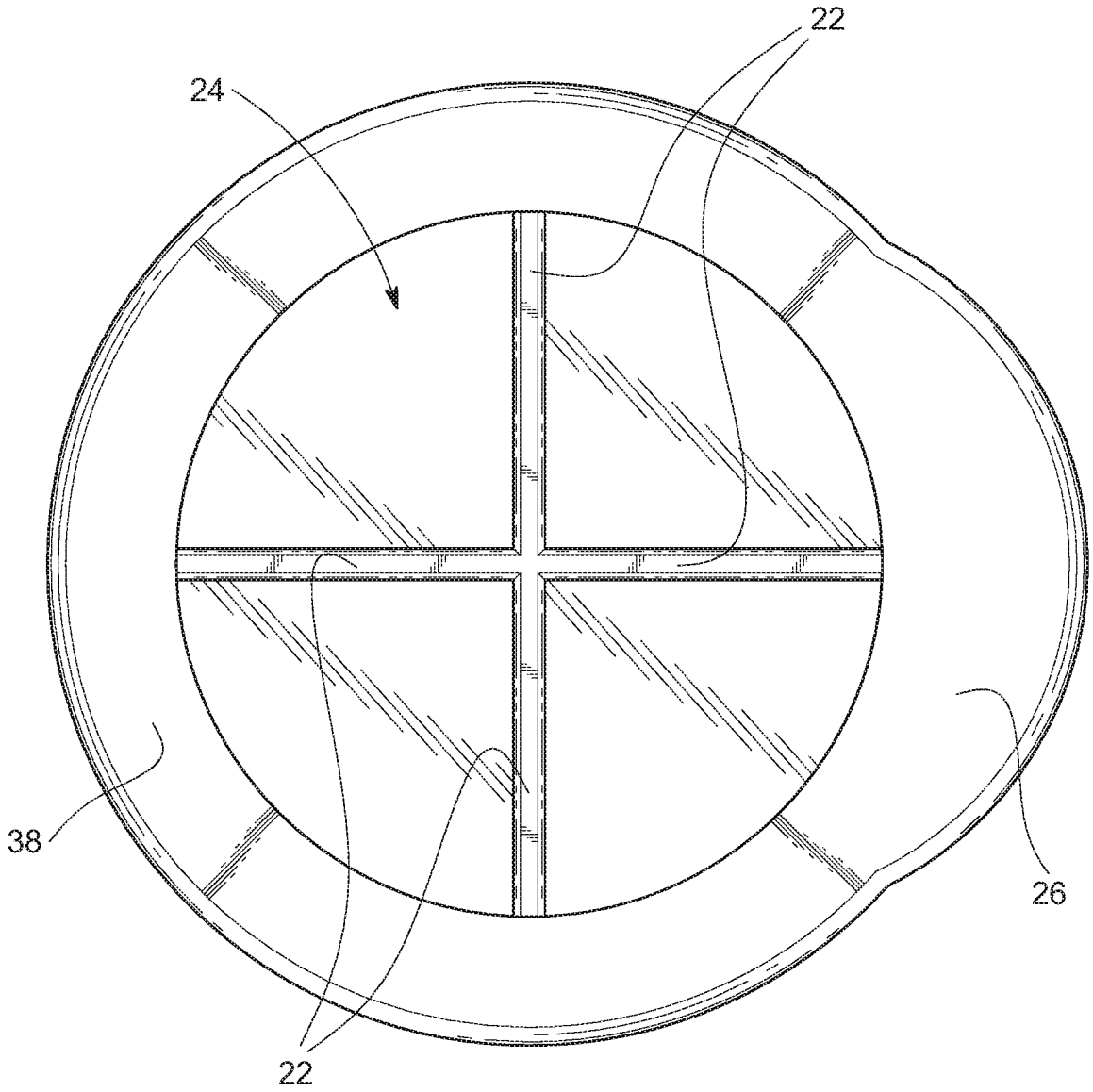
FIG. 7 is a top view of the cap shown in FIG. 2.
Figure 8:
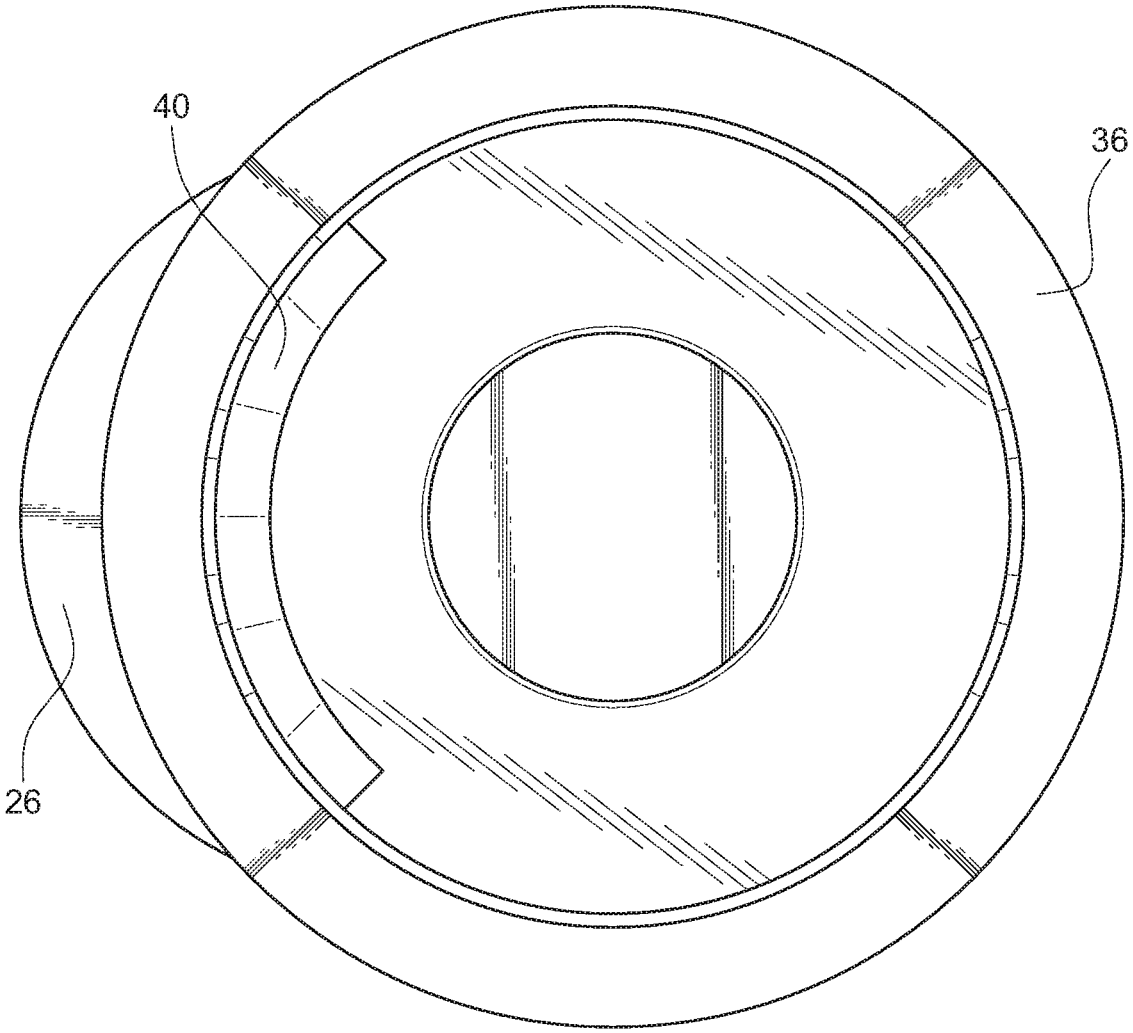
FIG. 8 is a bottom view of the cap shown in FIG. 2.

As seen in FIG. 7, the upper surface 38 of the top ring 21 is generally flat and circular in shape. A crescent shaped tab 26 protrudes from the perimeter of the upper surface 38 of the top ring 21. The tab 26 allows for improved ergonomic use and ease of digital manipulation when opening the cap 20 with one's hand. The tab 26 also allows for improved finger grip such that the cigar tube assembly 10 can be opened with one hand. It is understood that the tab 26 may take the form of a number of different shapes or sizes, and is not limited to a crescent shape.

Referring back to FIGS. 2-6, the cap 20 also has a sealing portion 28 attached to the lower surface 36 of the cap 20. The sealing portion 28 of the cap 20 has an upper sealing portion 32 and a lower sealing portion 30. The sealing portion 28 is narrower in diameter than the ring portion 21 to enable the sealing portion to be inserted into the cigar tube 50.

The sealing portion 32 has a notched cutout or groove 34 between the upper sealing portion 32 and the lower sealing portion 30. The notched cutout or groove 34 is has a smaller diameter than the upper sealing portion 32 and lower sealing portion 30.

Figure 9:
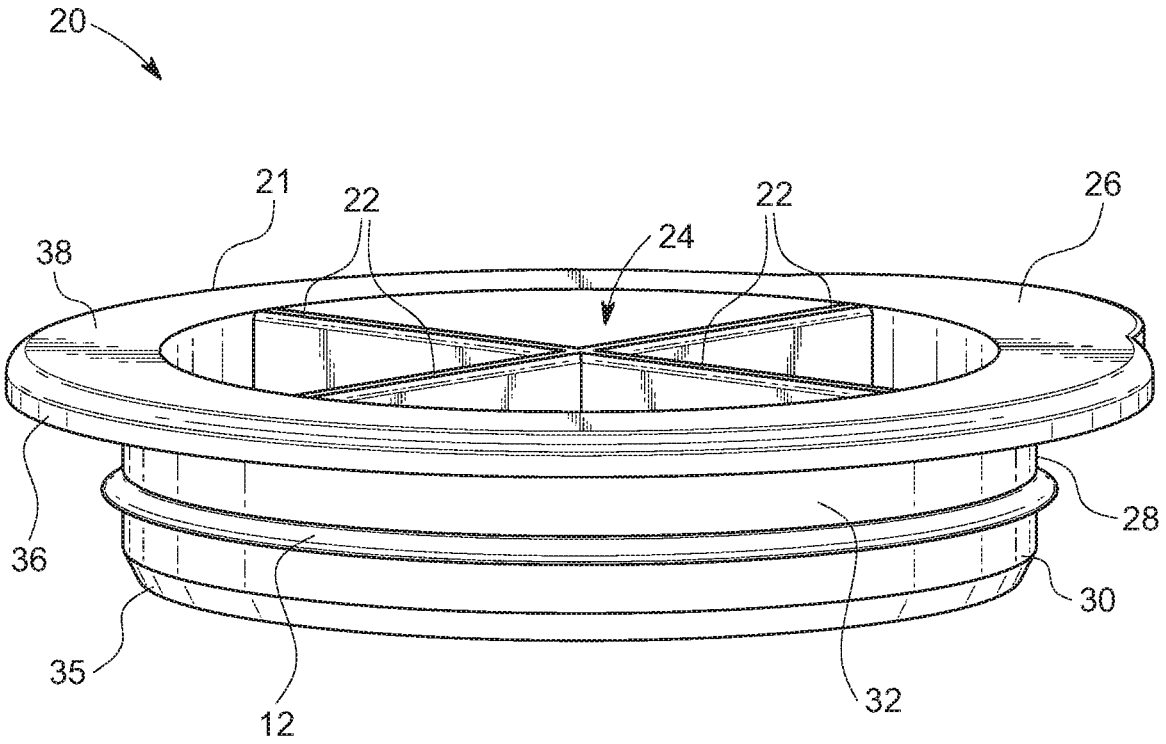
FIG. 9 is a perspective view of the cap shown in FIG. 2, to which a sealing ring (O-ring) is attached.

The notched cutout or groove 34 can receive the O-Ring 12, and as shown in FIG. 9, the O-Ring 12 can sit securely in the groove 34. The O-Ring 12 is slightly bigger than the groove 34, such that the inner portion of the O-Ring 12 is positioned within the groove 34 and the outer portion of the O-Ring 12 protrudes from the groove 34.

The lower sealing portion 30 of the cap 20 has a generally cylindrical shape with a slight flange cut 35 running continuously along the entire perimeter along the bottom of the lower sealing portion 30. The slight flange cut 35 is angled outward from the lower sealing portion 30.

Figure 3:
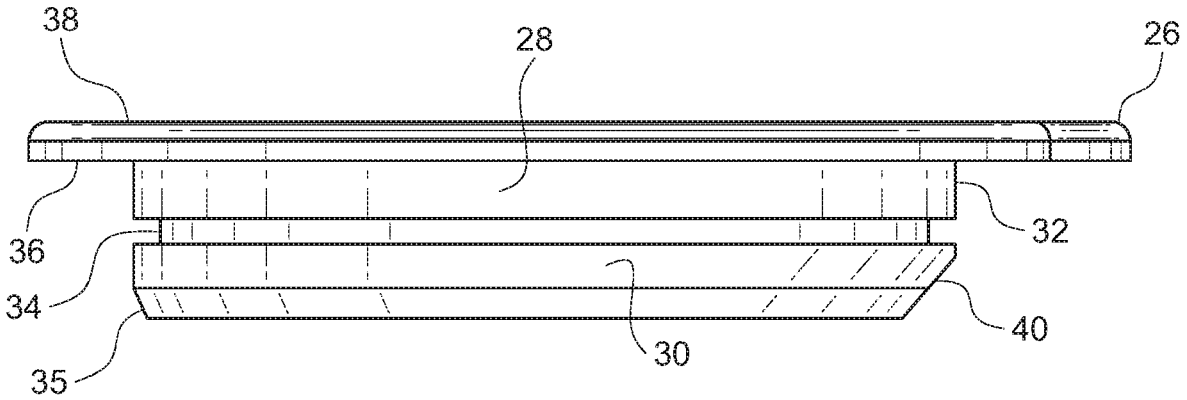
FIG. 3 is a left side view of the cap shown in FIG. 2.
Figure 4:
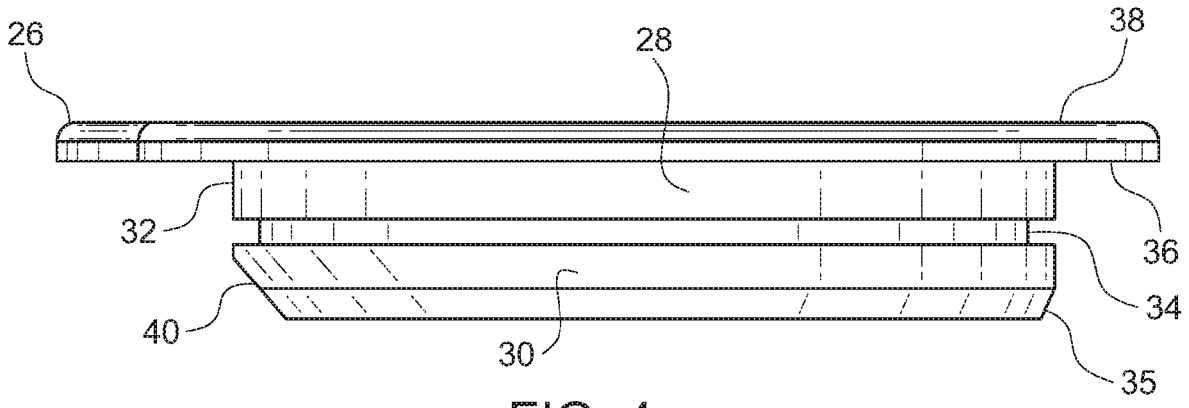
FIG. 4 is a right side view of the cap shown in FIG. 2.
Figure 5:
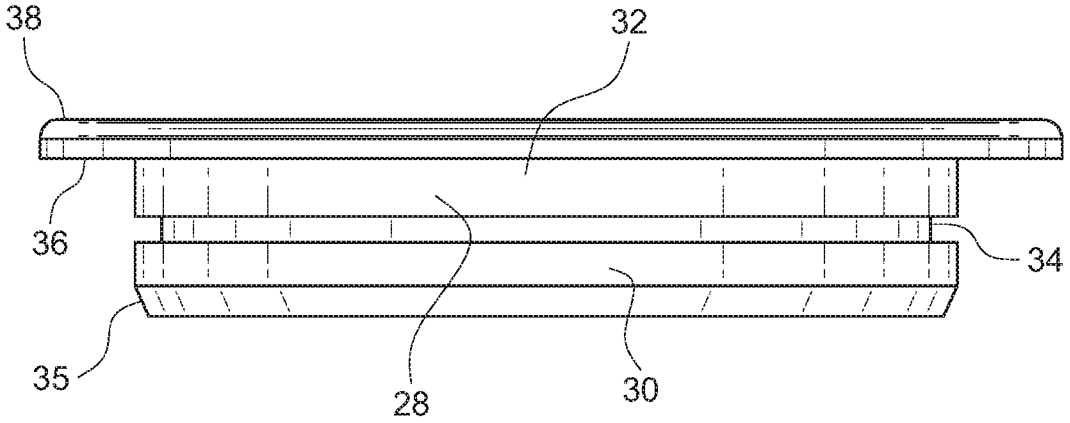
FIG. 5 is a rear view of the cap shown in FIG. 2.
Figure 6:
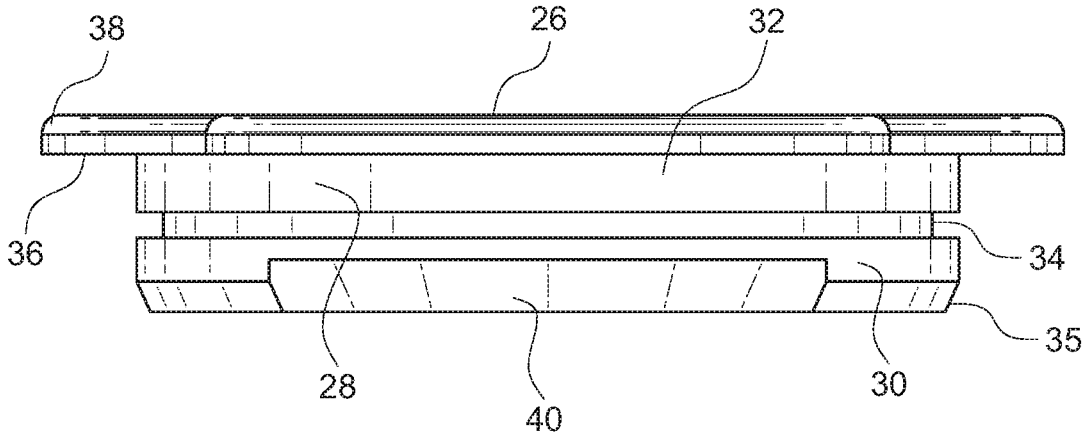
FIG. 6 is a front view of the cap shown in FIG. 2.

As shown in FIGS. 3-4 and 6, the lower sealing portion 30 of the cap 20 also has a second, larger flange 40 which is angled outward from the lower sealing portion 30. Paired with the slight flange cut 35, the angled flange 40 creates a double-flanged design. The angled flange 40 helps reduce frictional catching against the tube 50 and allows for improved ergonomic use and ease of digital manipulation when opening the cap 20 with one's hand or fingers. It is understood that the flange 40 may take the form of many different lengths and sizes, and may be cut at a variety of angles. Preferably, the flange 40 will be positioned generally beneath the tab 26.

Figure 10:
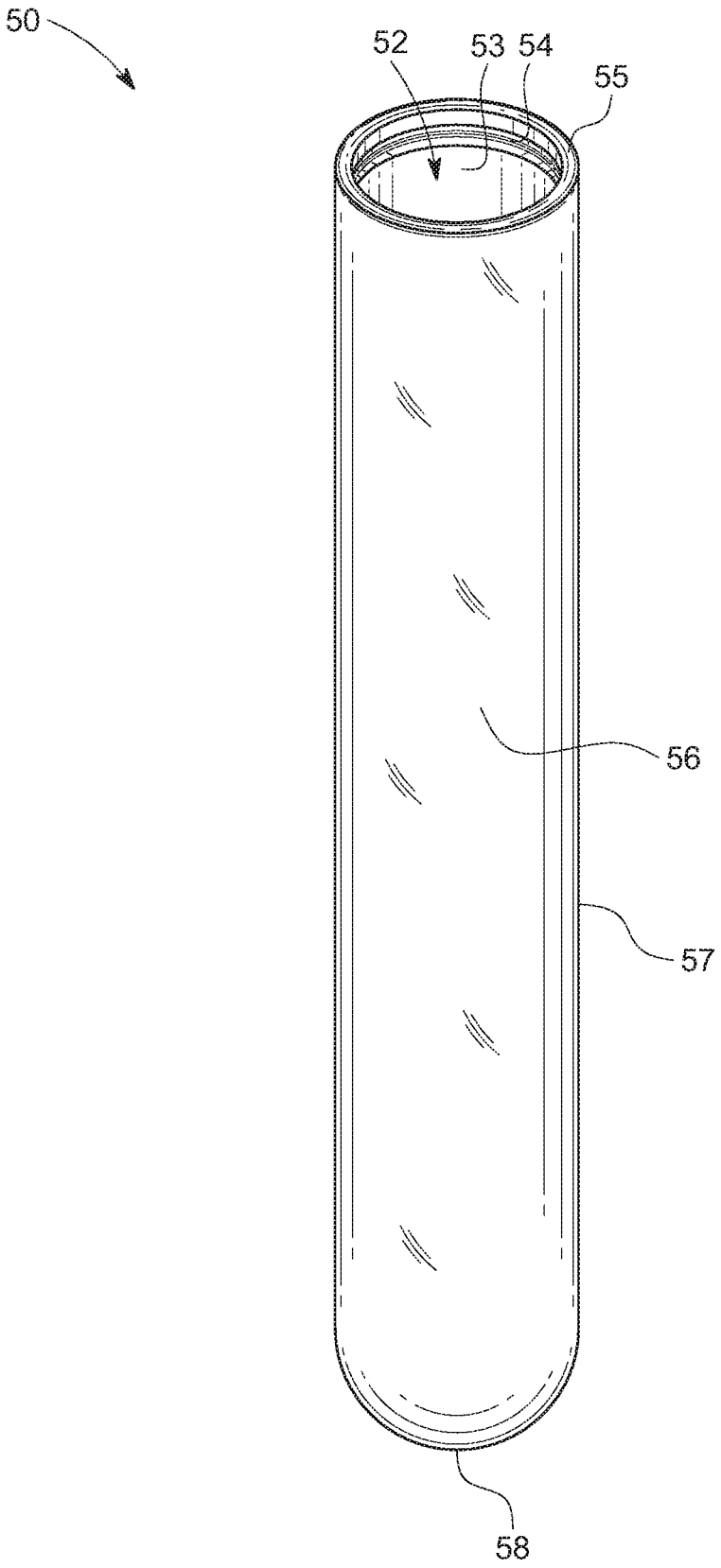
FIG. 10 is a side perspective view of the storage tube shown in FIG. 1.
Figure 11:
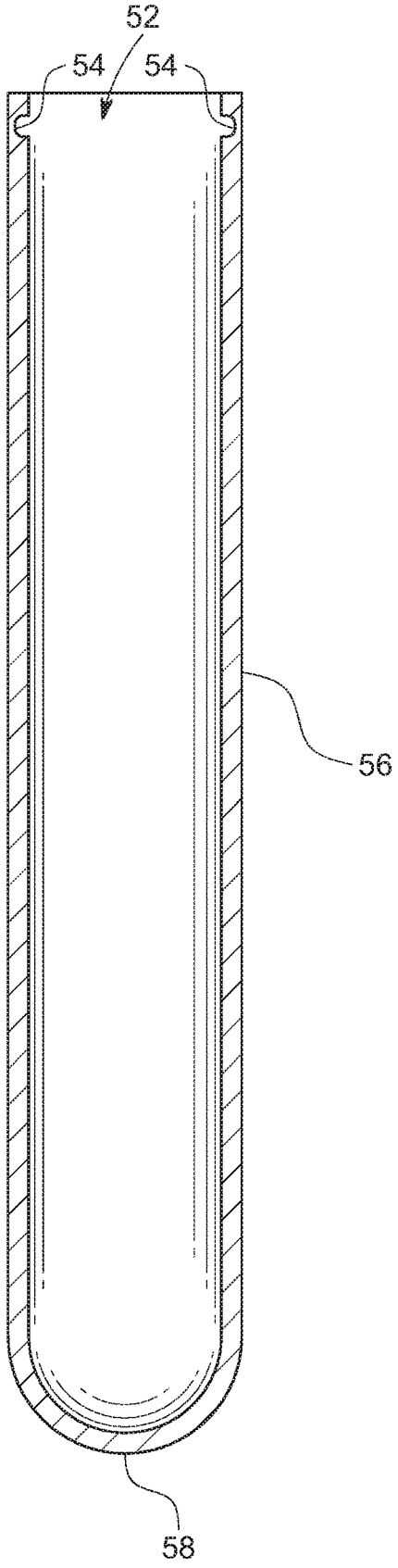
FIG. 11 is a cross-sectional side view of the tube shown in FIG. 10.

As shown in FIGS. 10 and 11, a first embodiment of the tube 50 is shown. The tube 50 has an elongated cylindrical portion 56 with a closed end 58 and an open end 52. The elongated cylindrical portion 56, which is hollow to allow for a cigar or cigars to be housed within, has an exterior wall 57 and an inner wall 53. As shown, the inner wall 53 contains a generally round-shaped side cut 54 along the perimeter of the inner wall 53 near the open end 52 of the tube 50. The side cut 54 is made in the inner wall 53 of the tube 50 such that its diameter exceeds that of the opening at the open end 52. When the cap 20 is placed on the tube 50, the groove 34 of the sealing portion 28 holding the O-Ring 12 is inserted into the tube 50 such that the outer portion of the O-Ring 12 is received by, and partially sits within, the side cut 54 in the perimeter of the inner wall 53 where it sits snuggly, creating a secondary seal that is generally air-tight. Because of its elastomeric properties, the O-Ring 12 creates a seal with the walls of the groove 34 on the cap 20 and with the walls of the side cut 54 on the tube 50. In other words, the cut 54 in the inner wall 53 of the tube 50 is positioned such that when the O-ring or sealing ring 12 is positioned within the groove 34 of the cap 20 and the cap 20 is placed into an open end of the tube 50, the O-ring 12 forms a seal between the tube 50 and the cap 20.

Also, when the cap 20 is placed on the cigar tube 50, the sealing portion 28 is inserted into the open end 52 of the tube 50, and the upper surface ring 38 remains exposed. When the cap 20 is placed on the tube 50, the lower surface ring 36 sits against a top surface 55 of the open end 52 of the tube 50 such that another seal is created.

The tube 50 may have any desired length, shape, and inner and outer diameters. Preferably the tube 50 will be of a size sufficient to permit the accommodation of items, such as cigars, of different lengths and diameters.

Figure 12:
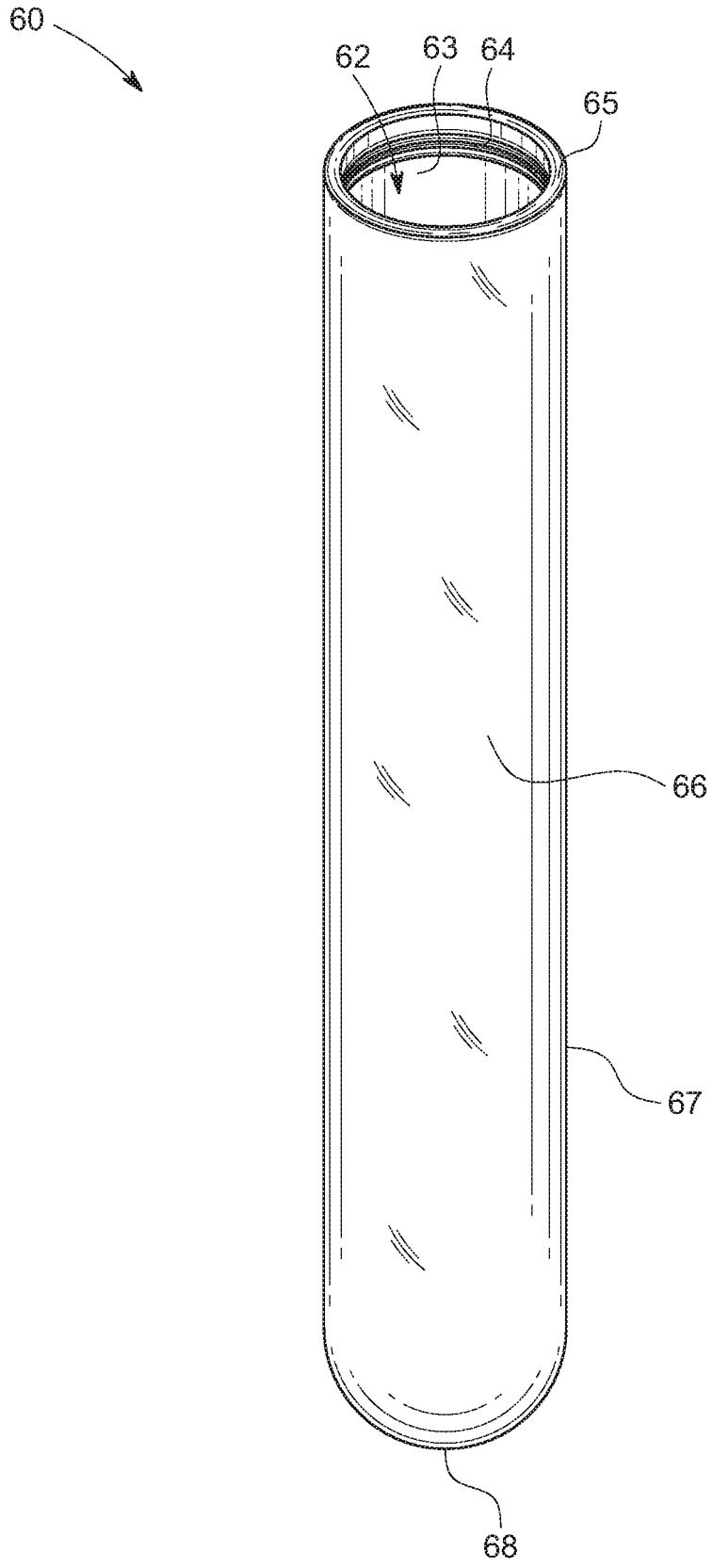
FIG. 12 is a side perspective view of a 2nd embodiment of a storage tube.
Figure 13:
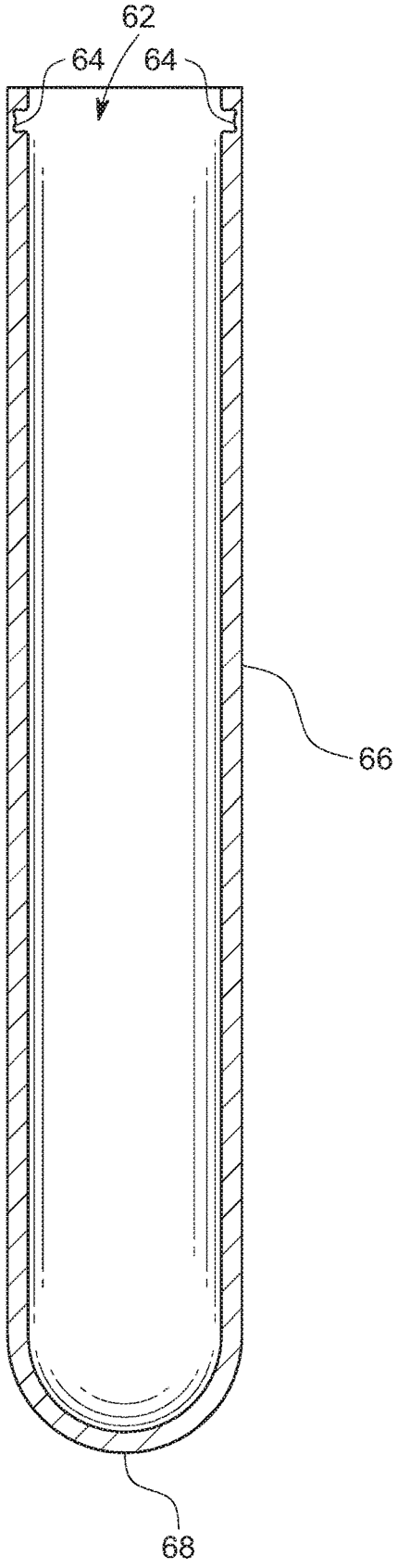
FIG. 13 is a cross-sectional side view of the tube shown in FIG. 12.

A second embodiment of the cigar tube 60 is shown in FIGS. 12 and 13. Similar to the first embodiment shown in FIGS. 10 and 11, the tube 60 also has a mechanism for sealing when the cap 20 is placed into the tube, except that the side cut 64 in the perimeter of the inner wall 63 is generally square-shaped.

Figure 14:
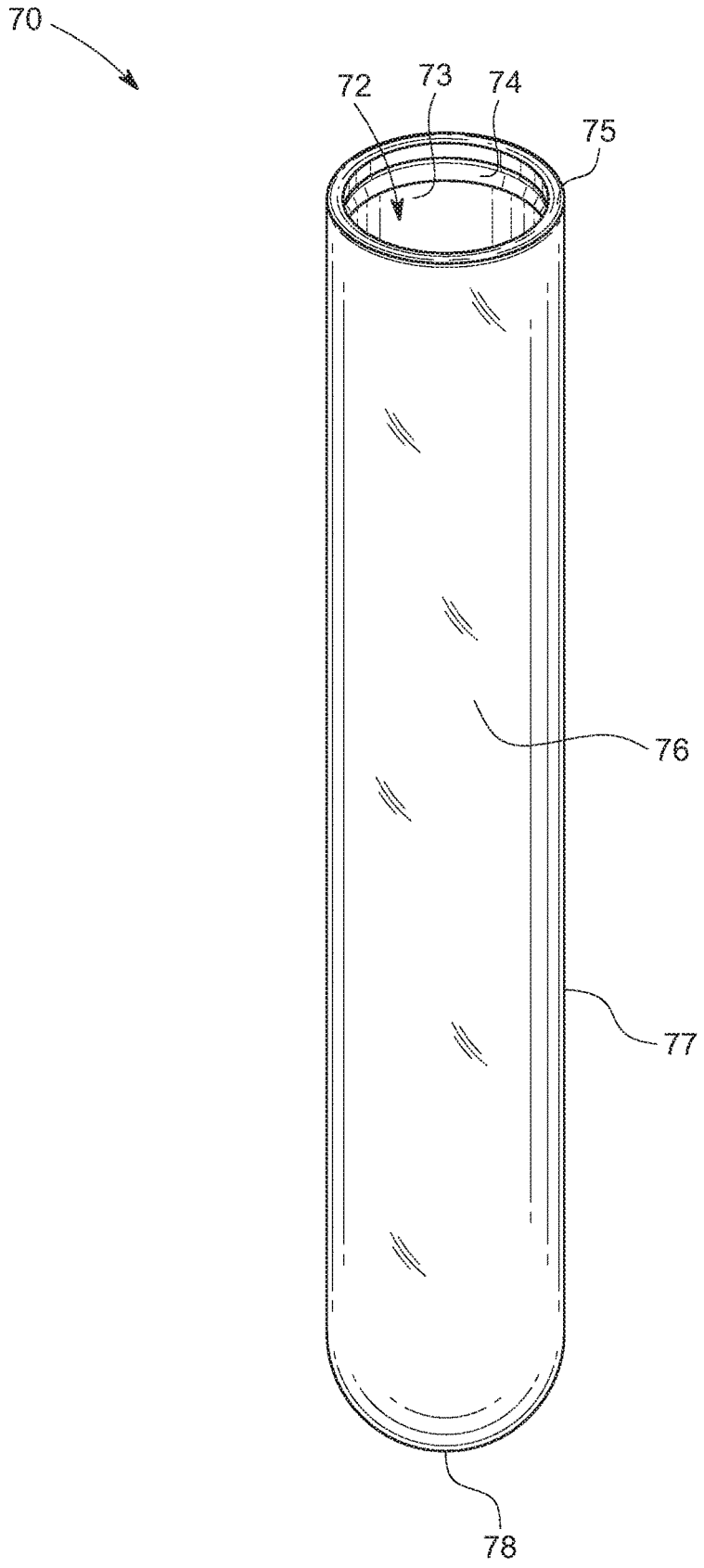
FIG. 14 is a side perspective view of a 3rd embodiment of a storage tube.
Figure 15:
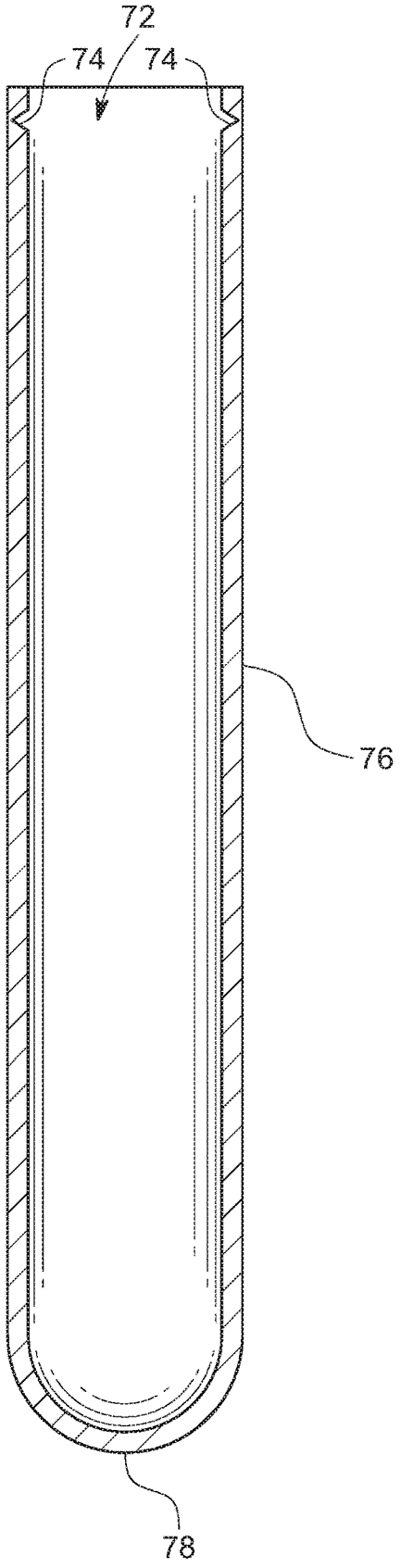
FIG. 15 is a cross-sectional side view of the tube shown in FIG. 14.

A third embodiment of the cigar tube 70 is shown in FIGS. 14 and 15. Similar to the first and second embodiments, the tube 70 also has a mechanism for sealing when the cap 20 is placed into the tube, except that the side cut 74 in the perimeter of the inner wall 73 positioned to receive the O-ring 12 is generally V-shaped.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A storage tube assembly, comprising:

a cap;

the cap has a top and a sealing member connected to the top;

wherein the top of the cap has a generally crescent shaped tab;

the sealing member has a generally cylindrical upper wall and a generally cylindrical lower wall;

the sealing member has a groove between the upper wall and lower wall;

a sealing ring;

the sealing ring is sized to be received within the groove of the sealing member of the cap;

a tube;

the tube has a generally circular inner wall with a cut therein;

the cut in the inner wall is positioned such that when the sealing ring is positioned within the groove of the cap and the cap is placed into an open end of the tube, the sealing ring forms a seal between the tube and the cap.

2. The storage tube assembly of claim 1, wherein the cut in the inner wall of the tube has a generally round cross-section.

3. The storage tube assembly of claim 1, wherein the cut in the inner wall of the tube has a generally square cross-section.

4. The storage tube assembly of claim 1, wherein the cut in the inner wall of the tube has a generally V-shaped cross-section.

5. The storage tube assembly of claim 1, wherein the sealing ring is made of an elastomeric material.

6. The storage tube assembly of claim 1, wherein the cap's sealing member also has a flange cut into a portion of the generally cylindrical lower wall.

7. The storage tube assembly of claim 6, wherein the flange extends generally outwardly from a bottom end of the cylindrical lower wall.

8. The storage tube assembly of claim 6, wherein the flange cut is positioned beneath the tab.

9. A storage tube assembly, comprising:

a cap;

the cap has a top and a sealing member connected to the top;

the cap has a tab protruding from the top;

wherein the tab protruding from the top is generally crescent shaped;

the sealing member has a generally cylindrical upper wall and a generally cylindrical lower wall;

the sealing member has a groove between the upper wall and lower wall;

a sealing ring;

the sealing ring is sized to be received within the groove of the sealing member of the cap;

a tube;

the tube has a generally circular inner wall;

when the sealing ring is positioned within the groove of the cap and the cap is placed into an open end of the tube, the sealing ring forms a seal between the tube and the cap.

10. The storage tube assembly of claim 9, wherein the tube has a generally circular inner wall with a cut therein.

11. The storage tube assembly of claim 10, wherein the cut is oriented such that when the sealing ring is positioned within the groove of the cap and the cap is placed into an open end of the tube, the sealing ring is received by the cut and forms a seal between the tube and the cap.

12. The storage tube assembly of claim 9, wherein the cap's sealing member has a flange cut into a portion of the generally cylindrical lower wall.

13. The storage tube assembly of claim 12, wherein the flange extends generally outwardly from a bottom end of the cylindrical lower wall.

14. The storage tube assembly of claim 12, wherein the flange cut is positioned beneath the tab.

15. A storage tube assembly, comprising:

a cap;

the cap has a top and a sealing member connected to the top;

the sealing member has a generally cylindrical upper wall and a generally cylindrical lower wall;

the sealing member has a flange cut into a portion of the generally cylindrical lower wall the sealing member has a groove between the upper wall and lower wall;

a sealing ring;

the sealing ring is sized to be received within the groove of the sealing member of the cap;

a tube;

the tube has a generally circular inner wall;

when the sealing ring is positioned within the groove of the cap and the cap is placed into an open end of the tube, the sealing ring forms a seal between the tube and the cap.

16. The storage tube assembly of claim 15, wherein the flange extends generally outwardly from a bottom end of the cylindrical lower wall.

17. The storage tube assembly of claim 15, wherein the top of the cap has a tab protruding from the top.

18. The storage tube assembly of claim 17, wherein the tab protruding from the top is generally crescent shaped.

* * * * *